US009739247B2

(12) United States Patent
Sumida et al.

(10) Patent No.: US 9,739,247 B2
(45) Date of Patent: Aug. 22, 2017

(54) MIST FORMING METHOD USING FLUID INJECTION VALVE, FLUID INJECTION VALVE, AND MIST FORMING APPARATUS

(75) Inventors: Mamoru Sumida, Chiyoda-ku (JP); Tatsuya Nakayama, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 820 days.

(21) Appl. No.: 13/428,027

(22) Filed: Mar. 23, 2012

(65) Prior Publication Data

US 2013/0099015 A1 Apr. 25, 2013

(30) Foreign Application Priority Data

Oct. 19, 2011 (JP) ..... 2011-229503

(51) Int. Cl.
*F02M 61/00* (2006.01)
*F02M 61/18* (2006.01)
*F02M 61/16* (2006.01)

(52) U.S. Cl.
CPC ..... *F02M 61/184* (2013.01); *F02M 61/162* (2013.01); *F02M 61/18* (2013.01); *F02M 61/1806* (2013.01); *F02M 61/186* (2013.01); *F02M 61/1813* (2013.01); *F02M 61/1853* (2013.01)

(58) Field of Classification Search
CPC ..... F02M 61/1806; F02M 61/1813; F02M 61/1853; F02M 61/186; F02M 61/1866; F02M 51/0671; F02M 51/0678; F02M 61/18
USPC ..... 239/5, 533.12, DIG. 7
See application file for complete search history.

(56) References Cited

U.S. PATENT DOCUMENTS

| | | | | |
|---|---|---|---|---|
| 6,168,099 | B1 | 1/2001 | Hopf et al. | |
| 6,994,279 | B2 * | 2/2006 | Saito et al. | 239/533.12 |
| 2007/0012803 | A1 * | 1/2007 | Shimizu et al. | 239/497 |
| 2008/0116301 | A1 * | 5/2008 | Yasukawa | F02M 61/18 239/533.12 |

(Continued)

FOREIGN PATENT DOCUMENTS

| | | |
|---|---|---|
| JP | 2000-104647 A | 4/2000 |
| JP | 2004-225598 A | 8/2004 |

(Continued)

*Primary Examiner* — Arthur O Hall
*Assistant Examiner* — Alexander Valvis
(74) *Attorney, Agent, or Firm* — Sughrue Mion, PLLC; Richard C. Turner

(57) ABSTRACT

A mist forming method using a fluid injection valve formed of a valve seat, a valve body, and a nozzle portion or an injection hole plate having injection holes, and configured to turn in-hole flows and flows immediately below the injection holes into substantially liquid film flows. Directions of jets from the injection holes are not necessarily brought into coincidence with a center axis direction of the injection holes and are not necessarily crossed with one another in a downstream part, and after the jets turned into mists at a position downstream of a break length position, the mists are allowed to come close or gather by the Coanda effect so as to appear substantially as one solid mist, and allowed to keep gathering until catching of ambient air and a resulting air flow along a downstream flow direction in a predetermined in-mist portion attenuate.

12 Claims, 18 Drawing Sheets

(56) References Cited

U.S. PATENT DOCUMENTS

| | | | | |
|---|---|---|---|---|
| 2010/0090031 | A1* | 4/2010 | Hashii | F02M 61/18 239/533.12 |
| 2010/0237174 | A1* | 9/2010 | Oomori et al. | 239/533.12 |
| 2012/0325922 | A1* | 12/2012 | Sumida | F02M 61/1806 239/1 |

FOREIGN PATENT DOCUMENTS

| | | | |
|---|---|---|---|
| JP | 2005-207236 | A | 8/2005 |
| JP | 2005-233145 | A | 9/2005 |
| JP | 2007-077809 | A | 3/2007 |
| JP | 2008-169766 | A | 7/2008 |
| WO | 2008/093387 | A1 | 8/2008 |
| WO | 2008/117459 | A1 | 10/2008 |

* cited by examiner

MIST FORMING METHOD USING FLUID INJECTION VALVE, FLUID INJECTION VALVE, AND MIST FORMING APPARATUS

BACKGROUND OF THE INVENTION

Field of the Invention

The present invention relates to a mist forming method suitable for a fuel injection valve for internal combustion engine (hereinafter, referred to simply as the engine), a fluid injection valve, and a mist forming apparatus.

Background Art

Research and development on engines for vehicle, such as an automobile, are actively conducted to achieve less gas emission when the engine is cold and better fuel consumption by improving combustion characteristics through atomization of a fuel mist.

A fuel injection system of a gasoline engine is classified into a port injection system and an in-cylinder injection system. Three elements important to establish a combustion concept of the in-cylinder injection system are a mist specification (including an injection position), an in-cylinder air flow, and a shape of a combustion chamber. The combustion concept is established only when these elements are well matched. However, an in-cylinder pressure and an in-cylinder air flow vary with an engine speed and a load. An amount of fuel injection and injection timing are adjusted to such a variance and mist characteristics and an in-cylinder mist behavior vary with such an adjustment. Combined with restriction on the layout in an engine room, it is quite difficult to match the three elements always while suppressing adhesion of mist fuel onto an in-cylinder wall surface under various operating conditions.

Meanwhile, as with the three elements to establish the combustion concept of the in-cylinder injection system, it can be said that a mist specification (including an injection position), an intake air flow, and a shape of an intake port are three elements to achieve an optimal injection system in the port injection system. In the port injection system, it is typical for a dual-intake valve engine to inject fuel at the intake valves using corresponding two-direction spray (two-stream spray). In light of this configuration, development is under way to find a mist shape and a mist direction targeting method such that prevent adhesion of mists onto the wall surface of the intake port while enhancing atomization of mists. However, a shape of the intake port and an intake air flow under the influence thereof are not necessarily optimized because of the restriction on the layout in the engine room. Hence, a measure to achieve both of improvement of atomization of mists and a mist shape and an injection direction targeting method is not explicitly disclosed.

In the case of large- and medium-size two-wheel vehicles, many of the vehicles are incapable of injecting fuel at intake valves because of the layout restriction, and it is not certain which injection system concept is most suitable in this case. Expectations are therefore rising for the developments in the future.

Further, carburetors are being replaced by the port injection system in small-size two-wheel vehicles, outboard engines, and utility engines. However, many of these engines are single-intake valve engines and actual circumstances is that fuel is injected at the intake valve in some occasions and off the intake valve in the other occasions by one-direction spray (one-stream spray) also because of the layout problem. It is obvious that a reduction of emission gas and improvement of fuel consumption are demanded further and there is a need for an optimal specification at suppressed system costs.

As has been described, in the case of a mist specification by the two-stream spray, matching in a gasoline engine of the port injection system in the related art is carried out using parameters, specifically, a mist angle and an injection amount distribution image on a cross section perpendicular to an injection direction of each stream of spray, an injection angle of the two-stream spray (sandwiching angle), a content of atomization levels of the mists at a predetermined point.

More specifically, each stream of spray on a cross section perpendicular to the injection direction is of substantially a circular shape or substantially an elliptical shape. A basic specification of an injection amount distribution is substantially a conical solid distribution peaking substantially at or around a center, and atomization is enhanced as the need arises. A level of atomization and a mist angle are correlated with each other. Hence, when a priority is given to one, the other is forced to depend on the circumstances. An injection amount distribution peaks at or around the center because injection directions from respective injection holes are oriented in a direction in which the injection directions concentrate. Hence, a distribution ratio is relatively high at the center. The same can be said with a case of the one-stream spray.

To solve the problems discussed above, various proposals have been made for nozzles or mists as described, for example, in Patent Documents 1 through 6.

[Patent Documents]

Patent Document 1: JP-A-2005-233145

Patent Document 2: JP-A-2004-225598

Patent Document 3: JP-A-2008-169766

Patent Document 4: JP-A-2005-207236

Patent Document 5: JP-A-2007-77809

Patent Document 6: JP-A-2000-104647

None of these proposals, however, describes a measure to achieve both of improvement of atomization of mists and an increase in degree of design freedom for a mist shape, mist pattern, and an injection amount distribution. Hence, none of these proposals provides a guideline to determine an optimal mist specification in actual circumstances where a shape of the intake port and an intake air flow are different from one engine specification to another. Descriptions in this regard in Patent Documents 1 through 6 will be given one by one.

In Patent Document 1, atomization of fuel is promoted by securing an air region between liquid columns from multiple holes to reduce interference of the liquid columns and thereby promoting breakup of the liquid columns into mists. Atomization is promoted by arranging a location of the liquid columns like a part of the cone surface. In practice, it is necessary that most of fuel is turned to liquid threads or in a state close to liquid drops at a position at which interference of the liquid columns occurs. This is because atomization is deteriorated when interference occurs in a state of the liquid columns (see Paragraph [0006] of Patent Document 1). In other words, injection holes are merely located so that interference of the liquid columns occurs at a more downstream position and a measure to control a mist pattern and a shape of a whole mist both made up of a plurality of mists is not disclosed. It is therefore natural that the whole mist tends to spread and a degree of design freedom becomes small. Hence, applications of this proposal are limited by a shape of the intake port and a location of the intake valve.

In Patent Document 2, a gravity center of a fuel injection amount distribution is set closer to the inner sides than mist outline centers of the two-stream spray to form mists aiming at the more inner sides of the both intake valves. Hence, in a case where fuel adhering onto the back surfaces of the intake valves is blown off by an air current, an amount of fuel adhering onto a cylinder bore wall surface becomes minimum.

However, an atomization technique of jets from fuel injection valves is developed considerably in recent years. Accordingly, when an atomization level is put aside, fuel is turned to sufficiently broken up mists by the time the fuel arrives the intake valves. Hence, even during the exhaust stroke injection, there is more mist fuel floating in the intake port than mist fuel adhering onto the intake port and the intake valve due to an air flow in the closed intake port.

There are cases where perfect evaporation and perfect combustion of fuel in the cylinder cannot be expected by only an atomization effect exerted when fuel passes by a channel of the intake valve, and emission of unburnt hydrocarbon (HC) cannot be reduced sufficiently. In particular, temperatures of the intake port and the intake valve are low immediately after a cold start, and it cannot be expected that mist fuel or adhering fuel in these cold places evaporate soon.

Because the emission control is becoming stricter, even when atomization of fuel mists is promoted, it is also necessary to reduce emission of unburnt HC by reducing fuel adhesion onto the intake port and the intake valve. As adhesion of mist fuel onto the intake port and the intake valve is reduced more, a relation of an amount of injection and combustion performance in the corresponding cycles, that is, a relation among an emission gas, fuel consumption, and an output becomes clear. It thus becomes possible to further optimize the overall injection system including controllability.

It is therefore necessary to atomize mists as much as possible to achieve perfect evaporation and perfect combustion. However, Patent Document 2 fails to describe a realization means. Also, the injection amount distribution shown herein schematically shows an injection amount distribution for an image of independent liquid column jets from the respective injection holes when they turn into one jet by interfering with one another moderately, and therefore does not show an injection amount distribution when the liquid column jets from the respective injection holes break up and turn into mists. Accordingly, a shape of the intake port and a location of the intake valves to which the proposal is applicable are uncertain.

In Patent Document 3, atomization is promoted by arranging a location of the injection holes so that mists from the respective injection holes do not interfere with one another and a bias in an injection amount distribution is reduced. However, as with Patent Document 1, interference of mists is merely avoided in Patent Document 3. It is therefore natural that a mist pattern and a shape of a whole mist both made up of a plurality of mists tend to spread and a degree of design freedom becomes small. Hence, applications of this proposal are limited by a shape of the intake port and a location of the intake valves.

It is described that a bias in the injection amount distribution is reduced by locating the injection holes also on the inner side. However, it can be said that a bias in the injection amount of distribution is reduced relatively in comparison with a case where the injection holes are not located on the inner side. A description is not given as to in which manner an injection amount distribution with a reduced bias can be obtained by atomizing mists while avoiding interference among the independent liquid column jets from the respective injection holes. Accordingly, a shape of the intake port and a location of the intake valve to which the proposal is applicable are uncertain.

Patent Document 4 describes that it is preferable to form atomized mists obtained by collision and a lead mist having a high carrying force, so that a fuel mist concentration is made higher in the inner side direction than at the center position of the intake valve by suppressing scattering of the mists by letting the latter pull the former. However, in order to atomize the mists by letting jets collide, it is necessary to set a colliding position at a position shorter than a break length of the jets. In this case, being atomized, the jets (mists) scatter and part of energy of the jets is converted to a surface tension of scattered mist particles by collisions. Hence, a carrying force is reduced.

Even when mists scattered by collision and thereby having a lowered carrying force are pulled by the lead mist injected at the same time and having a high carrying force, timings of behaviors at the tip ends of these mists do not match in time. In the case of a small injection amount with a short injection period, mists scattered by collision are left behind and only the lead mist moves forward.

Besides the one shown in FIG. 4 of Patent Document 4, an attractive swirl developed by the lead mist forms an annular swirl on the outer periphery of the lead mist at a given downstream position in the injection direction determined by a balance of a shearing force between the outer periphery of the lead mist and the atmosphere at the same time. Hence, the scattered mists are caught into the annular swirl and can no longer move downstream in the injection direction.

As has been described, various restriction conditions are necessary for the lead mist to move forward while pulling scattered atomized mists. This proposal is therefore not suitable for the injection system for gasoline engine that is often in an unsteady state during a transient operation. Accordingly, there is a need for a method of increasing a degree of design freedom for a mist pattern and a shape of a whole mist more readily.

In Patent Document 5, a mist pattern is such that allows more fuel to adhere onto an umbrella portion of the intake valve by avoiding the intake valve system, and atomization while the mists pass through the intake valves is used. This proposal, however, has a problem same as that of Patent Document 2.

Patent Document 6 describes that irregularities in a travel direction of mists can be prevented because respective mists are atomized while avoiding interference among them and the respective mists move forward while attracting one another by the Coanda effect. It is, however, difficult to maintain a balance in the fuel direction to let the Coanda effect be exerted so that the respective mists do not spread too much on one hand and to suppress the Coanda effect so that the respective mists do not gather on the other hand even under a static atmospheric condition. Moreover, inside the intake port, there are influences of ambient air pressure and temperature, an intake air flow, a fuel volumetric (weight) flow rate, and a fuel velocity. Hence, it is quite difficult to implement this proposal in the injection system for gasoline engine that is often in an unsteady state during transient operation. In other words, because the Coanda effect does not play a role of actively forming a compact collective mist, a mist shape of a whole mist, a mist pattern, and an injection amount distribution depend on the circumstances.

SUMMARY OF THE INVENTION

The invention was devised in view of the problems discussed above and has an object to provide a mist forming method using a fluid injection valve, a fluid injection valve, and a mist forming apparatus, each of which achieves both of atomization of a fuel mist and a higher degree of design freedom for a mist shape, a mist pattern, and an injection amount distribution.

A mist forming method according to an aspect of the invention is a mist forming method using a fluid injection valve formed of a valve seat having a valve seat surface at a midpoint in a fluid channel, a valve body controlling opening and closing of the fluid channel by sitting on and leaving from the valve seat surface, and a nozzle portion or an injection hole plate located downstream of the valve seat and having a plurality of injection holes, and configured to turn respective in-hole flows and flows immediately below the respective injection holes into substantially liquid film flows.

Directions of jets from the respective injection holes are not necessarily brought into coincidence with a direction of a center axis of the injection holes and are not necessarily crossed with one another in a downstream part, and after the jets from the respective injection holes turned into mists at a position downstream of a break length position, the mists are allowed to come close to one another or gather by the Coanda effect exerted among a plurality of mists so that the mists appear substantially as one solid mist. Thereafter, the mists are allowed to catch ambient air chiefly based on a momentum theory (see Non-Patent Document 1) and thereby to induce an air flow along a downstream flow direction in a predetermined in-mist portion.

An injection amount distribution is maintained so as to peak at a predetermined portion and a mist angle is maintained small until behaviors as above vanish substantially.

More specifically, conditions are set so that Hypothesis (1) and Hypothesis (II) on p.821 of Non-Patent Document 1 are established. Then, mist particles are intensively gathered, for example, at the center of the mist by allowing momentum of the jet to migrate to air forming the mist so as to catch air. In this manner, the injection amount distribution is maintained so as to peak in a predetermined portion and at the same time, the mist angle is made smaller.

To describe a mist behavior more in detail, a mist behavior is such that makes it possible to achieve desired mist shape, mist pattern, and injection amount distribution by applying ideas in Non-Patent Document 2 and Non-Patent Document 3 to a mist behavior after mists injected from multiple injection holes at a low fuel pressure (at a level of about 1 MPa or below) come close to one another or gather by the Coanda effect and appear substantially as one solid mist.

Details of Non-Patent Documents 1 through 3 are as follows.

Non-Patent Document 1: "diizeru kikan nennryou funmu no toutatsu kyori ni kansuru kennkyu", Journal of the Japan Society of Mechanical Engineers (Part 2), vol. 25, issue 156, pp. 820-826

Non-Patent Document 2: "diizeru funmu kouzou ni ataeru funiki nennsei no eikyou", Journal of the Japan Society of Mechanical Engineers (Edition B), vol. 62, issue 599, pp. 2867-2873

Non-Patent Document 3: "diizeru funnmu ryuushi no kyodou ni kannsuru kennkyuu", Journal of the Japan Society of Mechanical Engineers (Edition B), vol. 64, issue 624, pp. 2722-2729

According to the mist forming method using a fluid injection valve configured as above, mists are floating in the intake port during exhaust stroke injection. Hence, during intake stroke injection, mists flow into a cylinder by following an intake air flow that flows into the cylinder from the intake valve. Accordingly, because formation of an air-fuel mixture takes place at an early stage, it becomes possible to form a more homogeneous air-fuel mixture in the cylinder.

In particular, in the port injection system, not only does it become possible to enhance atomization while the mists remains in a form applicable to the intake ports in various shapes and the intake valves located in various manners, more concretely, while maintaining a spread of a whole mist compact, but it also becomes possible to suppress adhesion of the mists onto the wall surface of the intake port and the intake valves without depending on injection timing.

The foregoing and other objects, features, aspects, and advantages of the present invention will become more apparent from the following detailed description of the present invention when taken conjunction with the accompanying drawings.

DESCRIPTION OF THE PREFERRED EMBODIMENTS

First Embodiment

Figure 1:
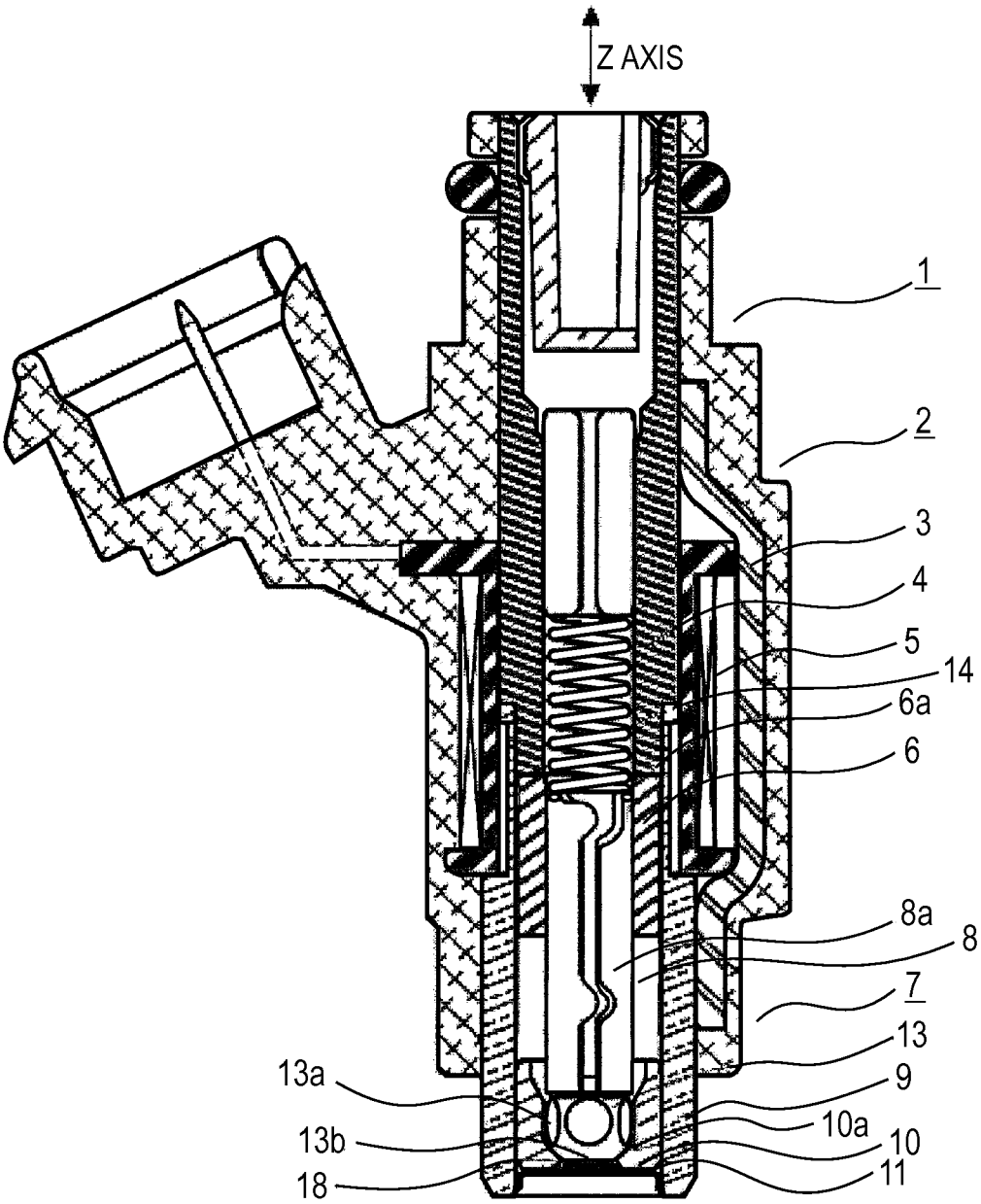
FIG. 1 is an overall cross section of a fuel injection valve according to a first embodiment of the invention.
Figure 2:
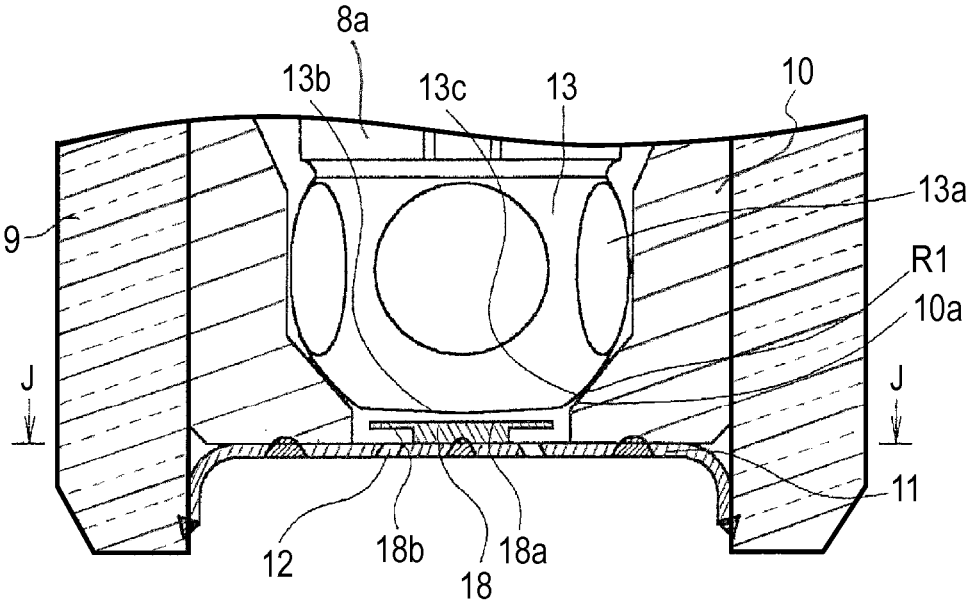
FIG. 2 is an enlarged view of a tip end of the fuel injection valve of FIG. 1.

A fuel injection valve according to a first embodiment of the invention will be described on the basis of FIG. 1 through FIG. 4. FIG. 1 is an overall cross section showing an entire fuel injection valve 1. FIG. 2 is an enlarged view of a tip end of the fuel injection valve 1 shown in FIG. 1. The fuel injection valve 1 is attached to an intake pipe of an internal combustion engine and supplies pressurized fuel toward the intake pipe from above.

A lower tip end of the fuel injection valve 1 is engaged on the inside of an intake port of the internal combustion engine and injects fuel downward. A solenoid device 2 generating an electromagnetic force is formed of a housing 3 forming a yoke portion of a magnetic circuit, a core 4 forming a fixed iron core, a coil 5 wound around the core 4, and an armature 6 as a movable iron core.

A valve device 7 joined to the solenoid device 2 is chiefly formed of a valve seat 10 provided inside a valve main body 9 at the tip end portion of the fuel injection valve 1, an injection hole plate 11 provided downstream of the valve seat 10, a cover plate 18 provided upstream of the injection hole plate 11 inside the valve seat 10, a valve body 8 in contact with the inner surfaces of the valve main body 9 and the valve seat 10 along the outer periphery, and a compression spring 14 provided upstream of the valve body 8. The valve body 8 has the armature 6 provided upstream of a hollow rod 8*a* and also has a ball 13 provided downstream of the hollow rod 8*a*.

The cover plate 18 is of a shape like a circular table and a pedestal portion 18*a* corresponding to legs of a table is fixed onto the injection hole plate 11 by welding. A thin portion 18*b* corresponding to a table plate is provided on the pedestal portion 18*a*.

The valve main body 9 is press-fit into a tip end outer diameter portion of the core 4 and welded. The rod 8*a* is press-fit to the inner surface of the armature 6 and welded. The ball 13 is welded to the rod 8*a* on the downstream side. Chamfered portions 13*a* parallel to a center axis Z of the injection fuel valve 1 is provided to a side surface of the ball 13. At the tip end of the fuel injection valve 1, the injection hole plate 11 is welded to the tip end surface of the valve seat 10 and the inner surface of the valve main body 9. A plurality of injection holes 12 are opened in the injection hole plate 11 so as penetrate in a plate thickness direction. Inlet sides of the injection holes 12 are located at equal intervals in close proximity to one another on the periphery of the pedestal portion 18*a*. Outlet sides of the injection holes 12 are opened outward from the inlet sides.

In a state where the coil 5 is not conducting, the valve body 8 is pressed downward by the compression spring 14 via the rod 8*a* while a ball surface 13*c* is in contact with a seat portion R1 of a valve seat surface 10*a*, so that a fuel channel is closed. When the coil 5 conducts, the valve body 8 provided integrally with the armature 6 starts to move upward and the ball surface 13*c* moves away from the valve seat surface 10*a*, so that the fuel channel is formed. When a top surface 6*a* of the armature 6 abuts on the core 4, the valve body 8 is brought into a fully opened stroke state.

Figure 3:
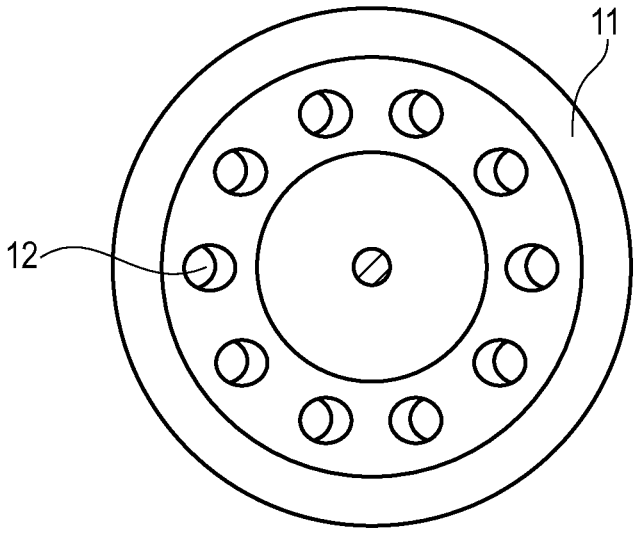
FIG. 3 is a plan view of an injection hole plate of FIG. 2.

FIG. 3 is a plan view of the injection hole plate 11 when viewed in a direction indicated by arrows J of FIG. 2. The injection hole plate 11 has ten injection holes 12 placed in a ring shape and oriented downstream and outward with respect to the Z axis of the fuel injection valve 1. In-hole center axes or jet directions are divided to injection hole groups (two-stream spray) headed to two directions on the left and right of FIG. 3 while pointing at an intake valve of the internal combustion engine.

An operation will now be described.

When an operation signal is sent to a drive circuit of the fuel injection valve 1 from an unillustrated control unit of the internal combustion engine, a current starts to flow through the coil 5 of the fuel injection valve 1. Then, the armature 6 is attracted toward the core 4 and the ball surface 13*c* of the valve body 8 provided integrally with the armature 6 moves away from the valve seat surface 10*a*. Consequently, a clearance is formed between the ball surface 13*c* and the valve seat surface 10*a* and fuel injection is started. Subsequently, the coil 5 stops conducting when an operation stop signal is sent to the drive circuit of the fuel injection valve 1 from the control unit of the internal combustion engine. Then, the valve body 8 is pushed toward the valve seat 10 by the compression spring 14 and the ball surface 13*c* and the valve seat surface 10*a* are brought into a closed state. Fuel injection is thus ended.

Figure 4:
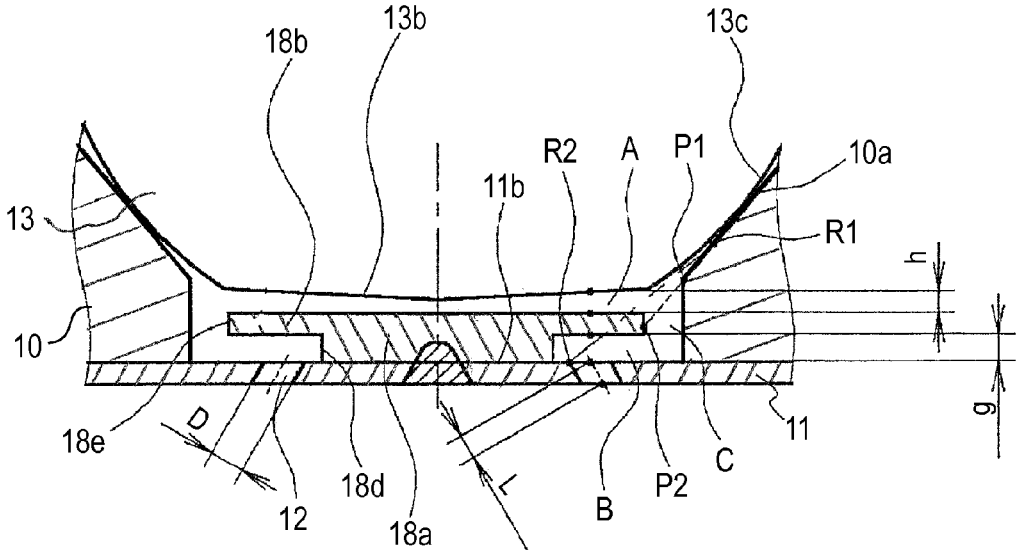
FIG. 4 is an enlarged view of a tip end of the fuel injection valve of FIG. 2.

Herein, positions, structures, and functions of the injection hole plate 11, the cover plate 18, the valve seat 10, and the ball 13, which turn an in-hole flow to a liquid film flow by contraction, will be described in detail using detailed cross sections of FIG. 2, FIG. 4, and FIG. 5.

When the valve body 8 is opened, fuel flows downstream in a space between the ball surface 13*c* and the valve seat surface 10*a* from a channel parallel to the Z axis and defined by the chamfered portions 13*a* of the ball 13 and the inner surface of the valve seat 10 and reaches the seat portion R1. Because fuel flows in parallel to the Z axis upstream of the seat portion R1, a flow that flows along the valve seat surface 10*a* by inertia is a master stream after the fuel passes by the seat portion R1 and the master stream reaches a point P1 at a downstream end of the valve seat surface 10*a*. The valve seat surface 10*a* bends at the point P1 and becomes parallel to the Z axis. Hence, the master stream of the fuel is separated from the point P1. An extended line from the valve seat surface 10*a* intersects with a side surface 18*e* of the thin portion 18*b* of the cover plate 18 at a point P2. The fuel separated from the point P1 is headed to the point P2, passes through an annular channel C, and flows into a radial channel B without making a noticeable turn in the radial direction.

The master stream of the fuel having passed by the seat portion R1 flows into the annular channel C. Hence, inflow into the clearance channel A between a ball bottom surface 13*b* and the cover plate 18 is suppressed. A straight line linking the seat portion R1 and a point R2 at the inlet of the injection hole 12 intersects with the thin portion 18*b* of the cover plate 18. The thin portion 18*b* blocks linear inflow of the fuel into the inlet of the injection hole 12 from the seat portion R1.

Accordingly, at least a part of the fuel flowing into the injection hole 12 forms a flow along the radial channel B. A terminal end face 18*d* of the radial channel B is located in close proximity to the injection hole 12 and closes a channel of a return flow flowing into the injection hole 12 from the side of the center axis of the fuel injection valve 1 to lower a velocity of the return flow. By suppressing the return flow, a velocity of a front flow flowing into the injection hole 12 from the side of the seat portion R1 is accelerated relatively. Because at least a part of the front flow is forced to turn significantly in the injection hole 12 after moving forward along the radial channel B and also because the front flow is fast, the fuel is pressed hard against an in-hole inner surface on the side of the center axis of the fuel injection valve 1 on the cross section of the injection hole 12. In FIG. 4, a capital L indicates a length of the injection hole 12 and a capital D indicates a diameter of the injection hole 12.

Figure 5:
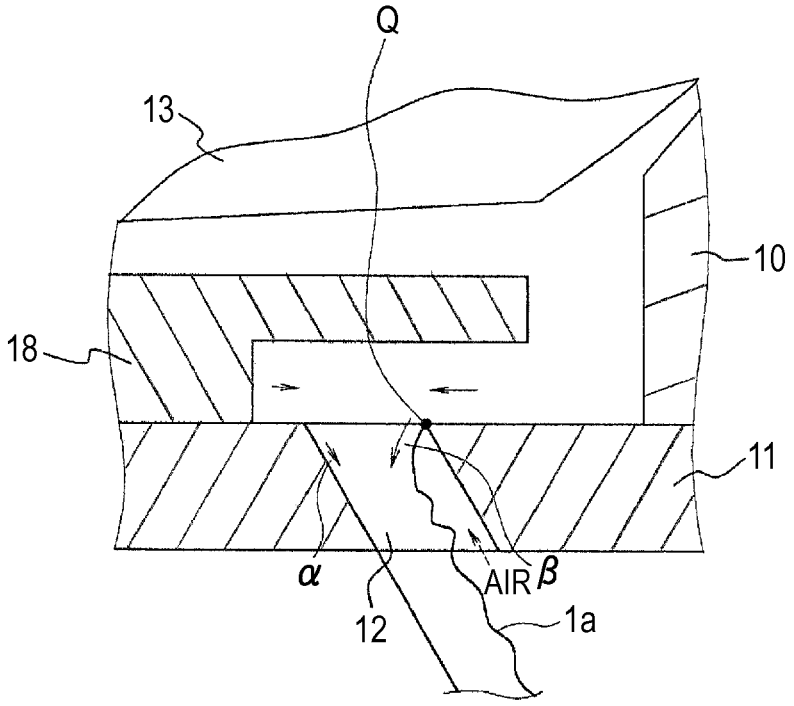
FIG. 5 is an enlarged view of an injection hole portion of FIG. 2.

Directions of a fuel flow and an air flow are indicated by arrows in a cross section of the injection hole 12 of FIG. 5. At the inlet of the injection hole 12, the slow return flow forms a flow $\alpha$ along the in-hole inner surface and the fast front flow forms a flow $\beta$ that presses the fuel against the in-hole inner surface. Air (indicated by an arrow labeled with AIR) is introduced to the vicinity of the inlet of the injection hole 12 from the outlet of the injection hole 12 to act on the fuel flow β and causes a separation of the fuel flow starting at a point Q. The fuel flow is pressed against the in-hole inner surface as it moves forward in the injection hole 12, and a liquid film changes in a direction along the in-hole inner surface while spreading in a circumferential direction of the in-hole inner surface. When the length L of the injection hole 12 is adequate for a height h of the radial channel B (see FIG. 4), the fuel is pressed against the in-hole inner surface in the injection hole 12 in the form of a thin liquid film flow. An injected fuel liquid film flow la starts to break up at a predetermined distance and eventually atomized liquid drops are formed by way of turning to liquid threads.

In the process of atomization, in order to make liquid drops small, it is effective to make liquid threads in the preceding step of breakup fine. In order to make the liquid threads fine, it is effective to make the liquid film in the preceding step of the breakup thin or make the liquid columns also in the preceding step of the breakup fine. It is known from the knowledge in the related art that the liquid film is more advantageous. Hence, besides the foregoing, various liquid film flow forming methods are proposed and one example describes that a liquid film flow is formed in the injection hole 12 by providing a swirl flow to a fuel flow before flowing into the injection hole 12.

The inventors conducted a research on liquid film flow forming methods and atomization processes and a relation of performances of a mist shape, a mist pattern, and an injection amount distribution of a whole mist made up of a plurality of mists based on these methods and processes and studied the results. Consequently, the inventors achieved a compact atomized mist when they discovered a fact that does not apply to the knowledge in the related art, "in order to atomize mists, it is only necessary to widen a spread angle of mists to avoid mist particles from being combined by collision", that is, a method with which atomization is not deteriorated even when an angle of mists is narrowed.

As has been described, various atomization methods are being applied to the fuel injection valves. However, from the start, there is a technique of providing multiple injection holes by making the injection holes smaller for atomization and a consideration is given so that an atomization state is not deteriorated as jets from adjacent injection holes interfere with each other. In other words, an injection hole location and injection hole data or an injection hole location and a jet direction are such that the jets move away from one another further at the in-hole center axis or as the jets move further downstream in the jet direction. Therefore, it is not difficult to achieve both of atomization and compact mists. In the port injection system, adhesion of fuel onto the intake port has no good influences and no advantages and it is therefore most crucial to suppress adhesion of fuel. Hence, even when atomization is enhanced to lower a ratio at which mists adhere onto the intake valve and the intake port in the vicinity of the intake valve, because a whole mist spreads and a mist side surface adheres onto another portion of the intake port as a result, an advantage as the port injection system is hardly achieved.

Meanwhile, in the type in which a spread of a whole mist is suppressed, an injection hole location and injection hole data or an injection hole location and a jet direction are such that the in-hole center axes or the jet directions interest with one another at the beginning of the lower stream. Hence, considerations are not given to requirements for atomization, such as a relation with a brake length. In addition, angle of the in-hole center axis is relatively small and this is disadvantageous to form a thin liquid film flow. Hence, because the atomization process is slowed down and jets readily interfere with one another, the atomization level fails to achieve an expected value.

The inventors paid attention to a difference between a behavior of a sole single mist and a behavior of a single mist among a plurality of mists and discovered a new phenomenon developed because of being an atomized mist. In other words, as an idea of determining an injection hole location and injection hole data, instead of determining a position, a shape, and an injection amount distribution of a whole mist in the lower stream by conducting a study three-dimensionally from the in-hole center axis or the jet direction, a study was conducted on an injection hole location and injection hole data such that control a behavior of the whole mist by understanding the characteristics thereof.

Figure 6A:
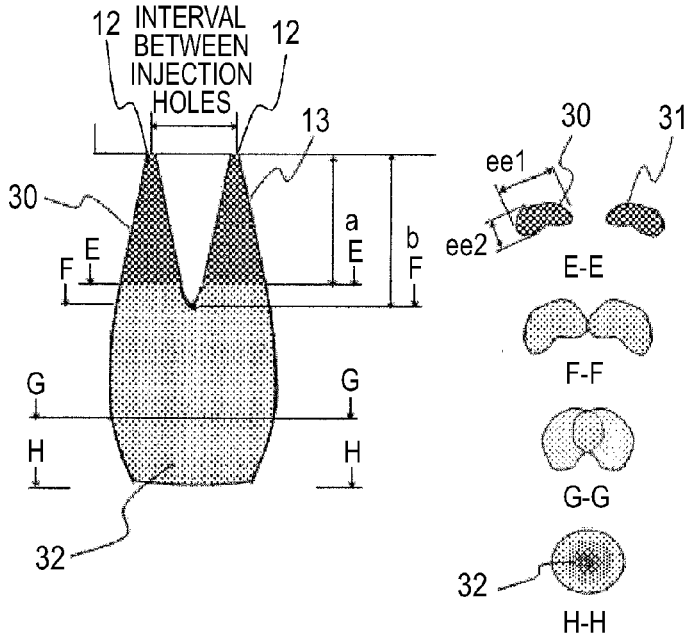
FIG. 6A through FIG. 6C are views used to describe a basic manner in which mists of the first embodiment and a second embodiment gather.

FIG. 6A shows in detail a basic behavior in this embodiment. Jets 30 and 31 from adjacent injection holes 12 and 12 are located as shown in a cross section taken on line E-E at a position of the brake length. Let a be the brake length. Then, two jets 30 and 31 starts to come into contact on the outlines (cross section taken on line F-F) at a position at a distance b from the injection holes 12 and 12, at which jets 30 and 31 break up and turn into mists . At the same time, from a state of the cross section taken on line F-F in which the two mists tend to oppose each other, the mists come close to each other by the Coanda effect exerted between the two mists due to a pressure distribution and gather as is shown in a cross section taken on line G-G. After the two mists appear substantially as one solid mist, the mists are allow to catch ambient air and thereby to induce an air flow along a downstream flow direction in a predetermined in-mist portion. Accordingly, the injection amount distribution peaks substantially at the center as is shown in a cross section taken on line H-H and a substantial mist angle becomes small. Consequently, a mist 32 is formed.

Figure 7A:
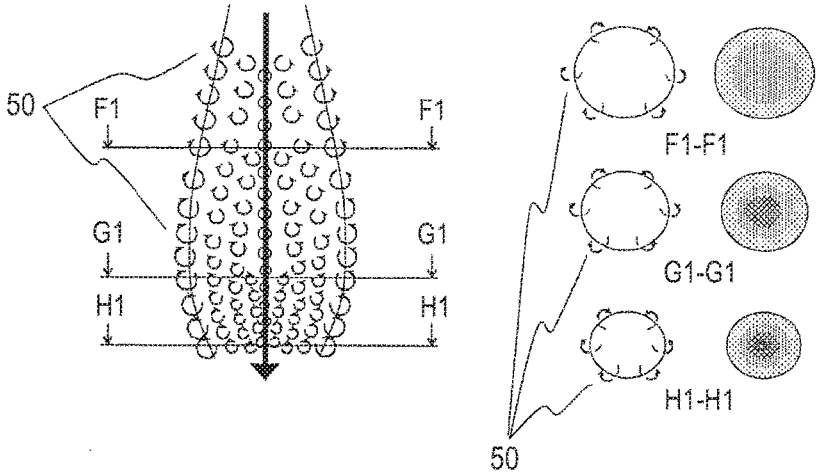
FIG. 7A and FIG. 7B are views used to describe the basic manner in which mists of the first embodiment and the second embodiment gather.
Figure 12A:
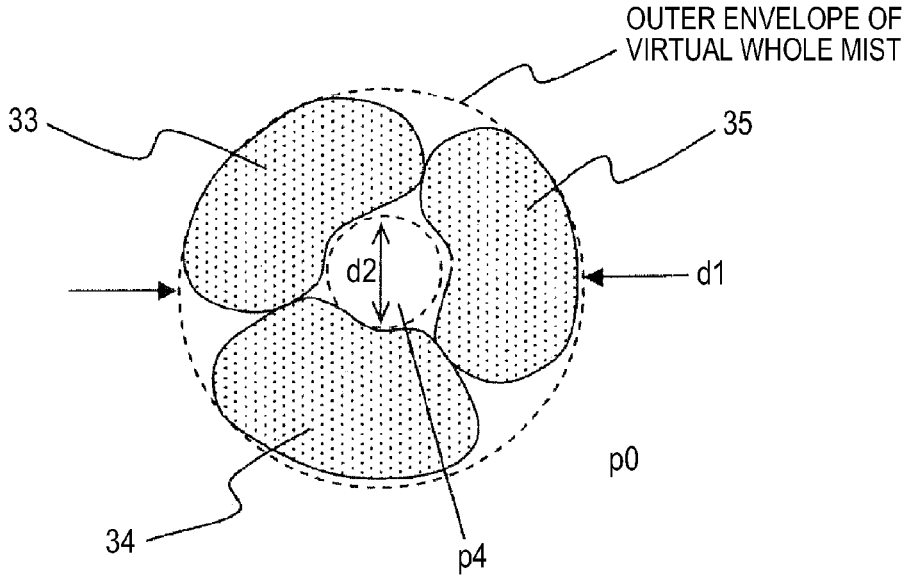
FIG. 12 is a view used to describe a manner in which mists of a seventh embodiment gather.
Figure 12B:
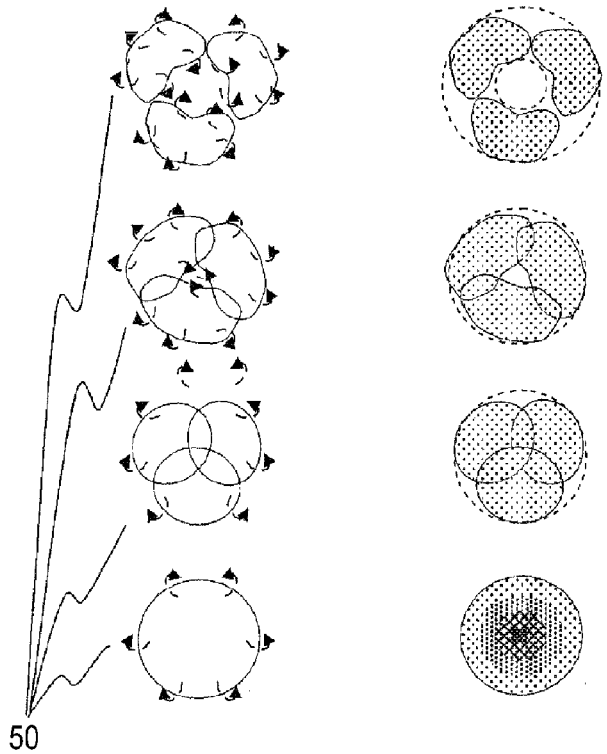

An ambient air catching level is not a level such that considerably changes an overall shape of the gathered mists (a level of FIG. 12A of Non-Patent Document 2 or a level of FIG. 12B only for fine mist particles), and the injection amount distribution peaks gradually at a predetermined portion. As a specific example, a behavior of one solid mist is shown in FIG. 7A. A manner in which ambient air is caught is shown by many spiral arrows 50 exaggeratingly for ease of understanding. Sizes and the number of the spiral arrows 50 therefore do not represent the actual condition. Also, an air flow V along a downstream flow direction is induced in a predetermined in-mist portion. Consequently, as are shown on the right of FIG. 7, the injection amount distribution in cross sections taken on lines F1-F1, G1-G1, and H1-H1 gradually peaks substantially at the center and a substantial mist angle becomes small at the same time. It thus becomes possible to achieve a compact mist.

Figure 7B:
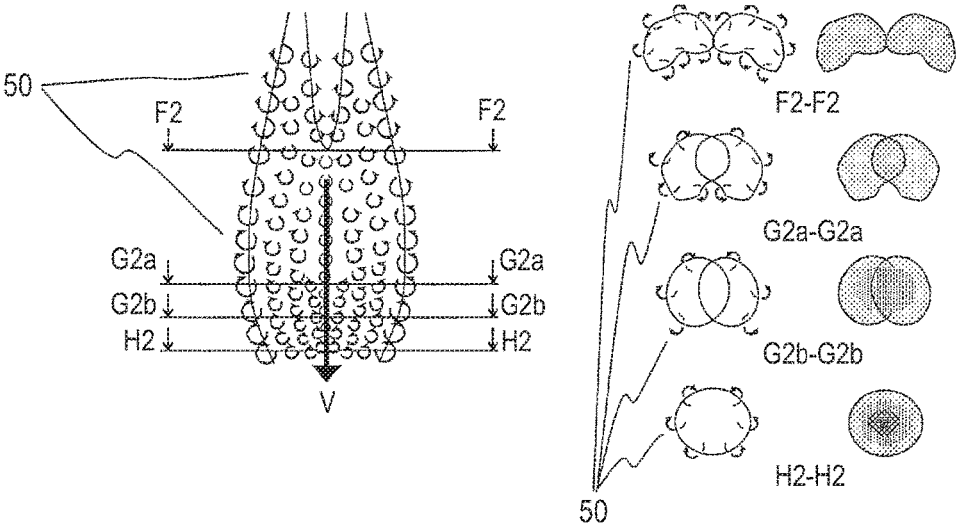

A behavior when this condition is applied to two mists after the two mists gather and appear substantially as one solid mist is shown in FIG. 7B. An idea is the same as that of a single mist. Hence, a behavior in the center of the mist dominates a behavior of a whole mist and a solid conical mist having a relatively small substantial mist angle can be achieved. Whether a liquid film flow can be formed and a level thereof are chiefly determined by a shape and a dimension, a location, a direction, an angle, an L/D (injection hole length/injection hole diameter) of the respective injection holes 12. It is therefore only necessary to determine a standard specification with which a necessary and sufficient atomization level is achieved. Then, because the brake length a of the respective jets can be estimated by a simulation, a shape and a dimension, a location, a direction, an angle, an L/D of the respective injection holes 12 or a shape and a dimension, a location, a direction, and a velocity of the respective jets are adjusted so that adjacent mists come close to each other or gather under influences of the Coanda effect at a position downstream of the position of the break length a.

The inventors repetitively conducted a study and found that it is suitable for mists to come close to each other or gather in such a manner that the respective mist outlines start to interfere with each other in a range from a position of the break length a to a position b of about twice the break length a (that is, $b \leq 2a$) with respect to the respective injection holes 12.

The number of mist particles is increased as smaller particles are atomized and therefore the number of swirls of air developed around the respective mist particles is increased. A static pressure of mist atmosphere drops in the vicinity of the respective swirls because of energy of the swirls. However, because the static pressure drops in many places, the Coanda effect is exerted uniformly more easily. Also, because the mist particles are small, the mist particles are more susceptible to the Coanda effect.

Consequently, the respective mists come closer to each other or gather (combine) closer. Hence, thereafter, the mists are more readily allowed to catch air thereby to induce an air flow along a downstream flow direction in a predetermined in-mist portion. It thus becomes possible to achieve a compact atomized mist. In the case of the port injection system, a density of mist particles in the lower stream of the break length is extremely low in comparison with mists for gasoline in-cylinder injection and mists for diesel (at a level of about 1/10 or less of that of mists for gasoline in-cylinder injection and about 1/100 or less of that of mists for diesel). Because these mist particles basically migrate in the same direction at the same velocity, it can be thought that the mist particles are hardly combined by collision. Also, in the case of the port injection system, it can be thought that a sole particle do not split at a fuel pressure level of 0.3 MPa.

Figure 6B:
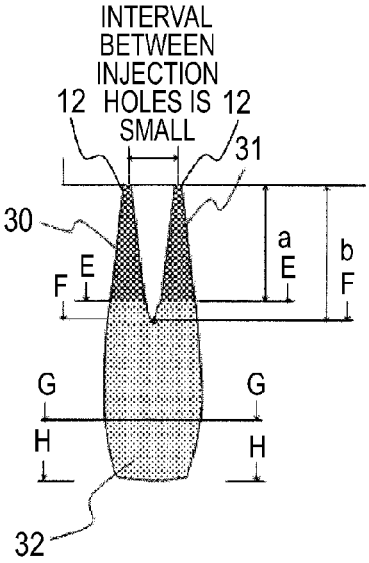
Figure 6C:
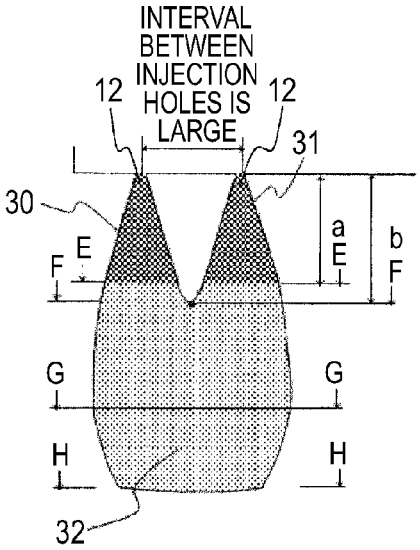

In order to develop the mist behavior as described above, a size and a dimension, a location, a direction, an angle, an L/D, or a shape of the nozzles provided upstream of the injection hole plate 11 may be different from one injection hole 12 to another and from one nozzle to another, or a size and a dimension, a location, a direction, and a velocity may be different from one jet to another. In other words, in a case where a more compact collective mist is required, a distance between the mists is shortened correspondingly to a small mist angle as is shown in FIG. 6B. Conversely, in a case where a slightly wider collective mist is required, a distance between the mists is extended correspondingly to a large mist angle as is shown in FIG. 6C.

As has been described, according to the first embodiment, a mist forming method uses the fluid injection valve 1 formed of the valve seat 10 having the valve seat surface 10*a* at a midpoint in a fluid channel, the valve body 8 controlling opening and closing of the fluid channel by sitting on and leaving from the valve seat surface 10*a*, and the injection hole plate 11 located downstream of the valve seat 10 and having a plurality of the injection holes 12, and configured to turn respective in-hole flows and flows immediately below the respective injection holes 12 into substantially liquid film flows. Directions of the jets 30 and 31 from the respective injection holes 12 and 12 are not necessarily brought into coincidence with a direction of a center axis of the injection holes 12 and are not necessarily crossed with each other in a downstream part, and after the jets 30 and 31 from the respective injection holes 12 turned into mists at a position downstream of a point of the break length a, the mists are allowed to come close to each other or gather by the Coanda effect exerted among a plurality of mists so that the mists appear substantially as one solid mist. Thereafter, the mists are allowed to catch ambient air chiefly based on the momentum theory and thereby to induce an air flow along a downstream flow direction in a predetermined in-mist portion. An injection amount distribution is maintained so as to peak at substantially a center and a mist angle is maintained small until behaviors as above vanish substantially. It thus becomes possible to achieve both of atomization of fuel mists and an increase in degree of freedom of a mist shape, a mist pattern, and an injection amount distribution. It is obvious that the injection amount distribution does not necessarily peak substantially at the center of across section of the mists and that the mist angle is not necessarily the minimum angle. It is also obvious that the same advantage can be achieved when the injection hole plate 11 and the valve seat 10 are provided integrally as a nozzle portion.

Second Embodiment

A second embodiment of the invention will be described using FIG. 6A.

The second embodiment is characterized in that, as is shown in the cross section taken on line E-E of FIG. 6A, an aspect ratio (ee1/ee2) of substantially an oval shape or substantially a crescent shape, which are a sectional shape of a jet immediately below each injection hole 12, is set to a value exceeding 1 (preferably, a value equal to or greater than 1.5). When configured in this manner, an area across which the mists oppose each other is increased so that the Coanda effect exerted due to a pressure distribution acts strongly and the mists come closer or gather closer. Then, after the mists appear substantially as one solid mist, the mists are allowed to catch ambient air chiefly based on the momentum theory and thereby to induce an air flow along a downstream flow direction in a predetermined in-mist portion. An injection amount distribution is maintained so as to peak substantially at the center and a mist angle is maintained small until behaviors as above vanish substantially. Owing to this configuration, it becomes possible to achieve a more compact atomized mist. An ambient air catching level and the behaviors can be thought to be the same as those in FIG. 7A.

Third Embodiment

A third embodiment of the invention will be described using FIG. 8A through FIG. 8D.

Figure 8A:
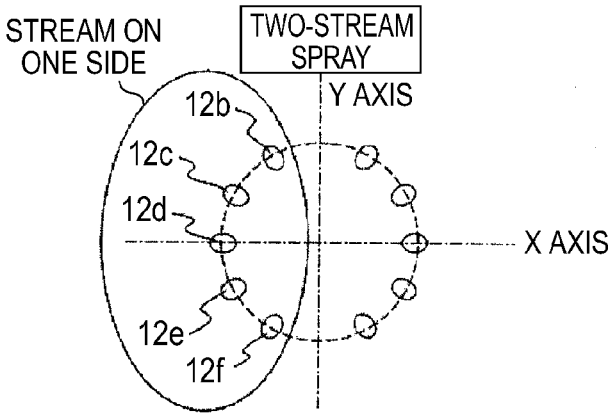
FIG. 8A through FIG. 8D are views used to describe a manner in which mists of a third embodiment gather.
Figure 8B:
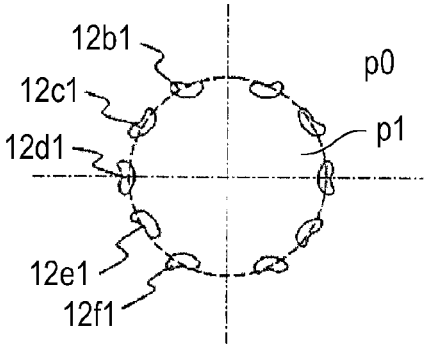
Figure 8C:
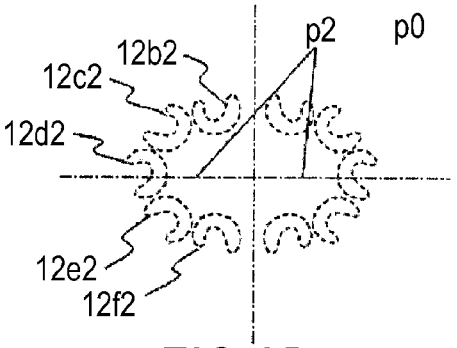
Figure 8D:
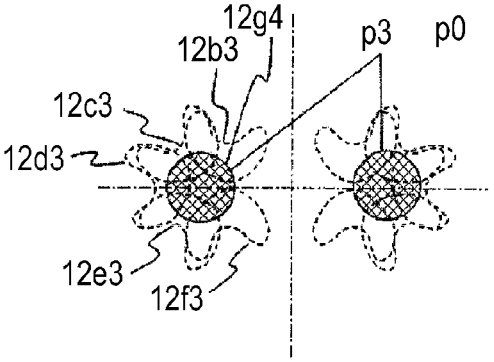

FIG. 8A is a plan view showing an example of an injection hole location when viewed from upstream in a direction of the center axis of the fuel injection valve 1 of a two-stream spray method. The respective injection holes 12*b* through 12*f* correspond to a stream of spray on one side of the two-stream spray and data may be different from one injection hole to another. FIG. 8B shows an example of a jet location and a jet shape immediately below the injection holes located as in the example of the injection hole location of FIG. 8A, and jets 12*b*1 through 12*f*1 in every adjacent pair are in close proximity to each other. FIG. 8C shows an example of a mist location and a mist shape in the lower stream of the break length position. It shows a state in which respective mists 12*b*2 through 12*f*2 gather so as to encircle the surroundings because the respective mists 12*b*2 through 12*f*2 are connected in the circumferential direction. FIG. 8D shows an example of a location and a shape of mists 12*b*3 through 12*f*3 when the Coanda effect is exerted thereon and an example of a mist location and a mist shape when a mist distribution is maintained so as to peak substantially at the center and a mist angle is maintained small until catching of ambient air by the mists and a behavior of a resulting air flow along a downstream flow direction in a predetermined in-mist portion taking place after the mists appear substantially as one solid mist vanish substantially. It shows a state in which a stream on one side of the two-stream spray is formed as a compact solid mist.

In the third embodiment, the jets 12*b*1 through 12*f*1 having a cross section of substantially an oval shape or substantially a crescent shape immediately below the corresponding injection holes are turned, respectively, into the mists 12*b*3 through 12*f*3 having a cross section of a polygonal shape at a position downstream of the break length position. The mists 12*b*3 through 12*f*3 having a cross section of a polygonal shape are formed by creating sides of substantially a polygonal shape by linking extended lines in a long axis direction of substantially an oval shape or in a normal direction to a curved portion of substantially a crescent shape, which are a sectional shape of the mists, or by allowing tip ends of substantially an oval shape or substantially a crescent shape to form vortexes of substantially a polygonal shape.

By configuring in such a manner that the jets turn into the mists 12*b*3 through 12*f*3 having a cross section of a polygonal shape at a position downstream of the break length position as above, a difference between internal and external pressures is readily generated (internal pressures p1, p2, and p3 become lower than an external pressure p0) in a cross section of a polygonal shape due to catching of internal air caused by jets and flows of mists. Hence, after the Coanda effect is exerted strongly and the mists come closer or gather closer so that the mists appear substantially as one solid mist, the mists are allowed to catch ambient air chiefly based on the momentum theory and thereby to induce an air flow along a downstream flow direction in a predetermined in-mist portion. Then, a mist distribution is maintained so as to peak substantially at the center and a mist angle is maintained small until behaviors as above vanish substantially. Owing to this configuration, it becomes possible to achieve a more compact atomized mist 12*g*4. Behaviors of jets from the adjacent injection holes and flows of mists and an ambient air catching level are the same as those in FIG. 6A through FIG. 7B. The two-stream spray is not necessarily symmetric with respect to the X axis or the Y axis.

Fourth Embodiment

A fourth embodiment of the invention will be described with reference to FIG. 9A and FIG. 9B.

Figure 9A:
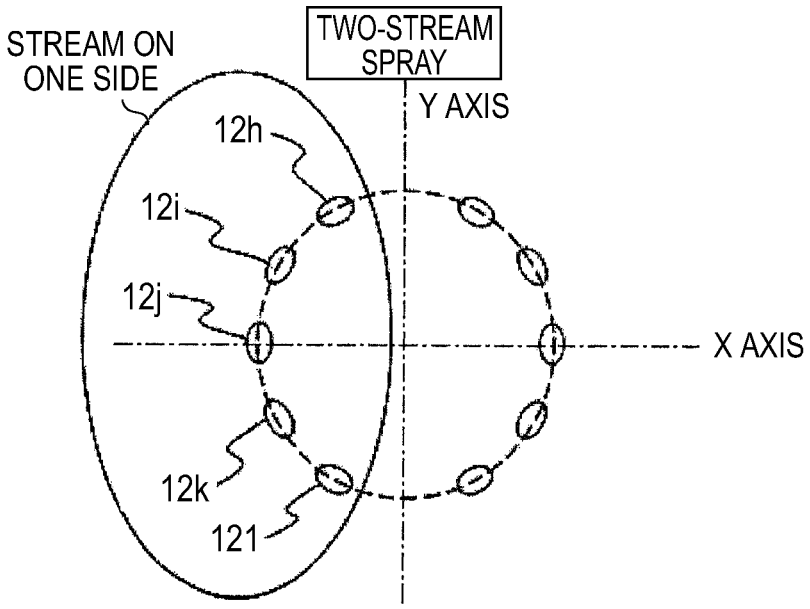
FIG. 9A and FIG. 9B are views used to describe a manner in which mists of a fourth embodiment gather.
Figure 9B:
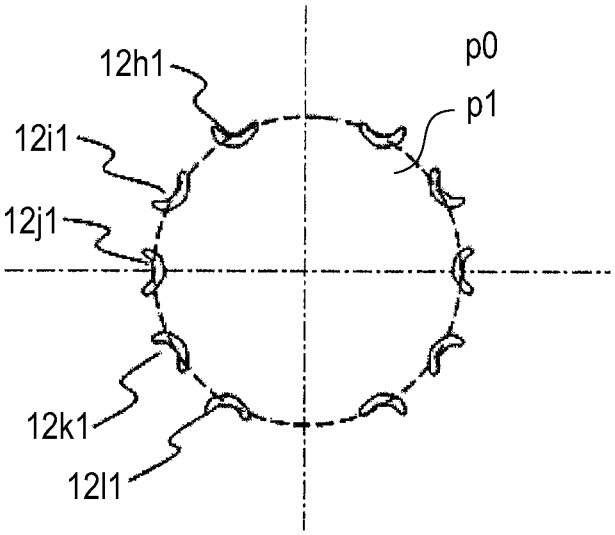

FIG. 9A is a plan view showing an example of an injection hole location when viewed from upstream in the direction of the center axis of the fuel injection valve 1 of the two-stream spray method. Respective injection holes 12*h* through 12*l* corresponds to a stream on one side of the two-stream spray and data may be different from one injection hole to another. FIG. 9B shows an example of a jet location and a jet shape immediately below the corresponding injection holes located as in the example of the injection hole location of FIG. 9A. An aspect ratio of a sectional shape of jets 12*h*1 through 12*l*1 immediately below the corresponding injection holes is set larger than 1.5.

In the fourth embodiment, an aspect ratio of a shape of the jets 12*h*1 through 12*l*1 immediately below the corresponding injection holes is set larger. Consequently, an internal pressure p1 can be set further lower than an external pressure p0. Hence, after the Coanda effect is exerted strongly and the mists come closer or gather closer so that the mists appear substantially as one solid mist, the mists are allowed to catch ambient air chiefly based on the momentum theory and thereby to induce an air flow along a downstream flow direction in a predetermined in-mist portion. Then, an injection amount distribution is maintained so as to peak substantially at the center and a mist angle is maintained small until behaviors as above vanish substantially. Owing to this configuration, it becomes possible to achieve a more compact atomized mist. Behaviors of jets from the adjacent injection holes and flows of mists and an ambient air catching level are the same as those in FIG. 6A through FIG. 7B. The two-stream spray is not necessarily symmetric with respect to the X axis or the Y axis.

Fifth Embodiment

A fifth embodiment of the invention will be described with reference to FIG. 10A through FIG. 10D.

Figure 10A:
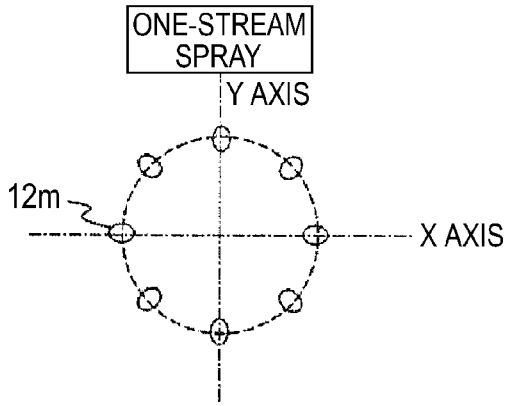
FIG. 10A through 10D are views used to describe a manner in which mists of a fifth embodiment gather.
Figure 10B:
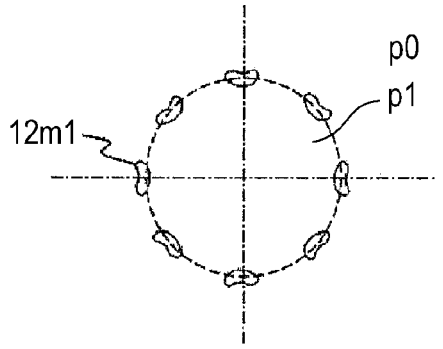
Figure 10C:
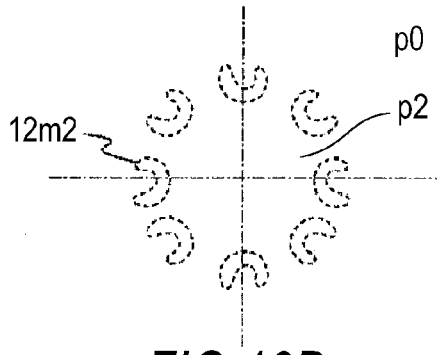
Figure 10D:
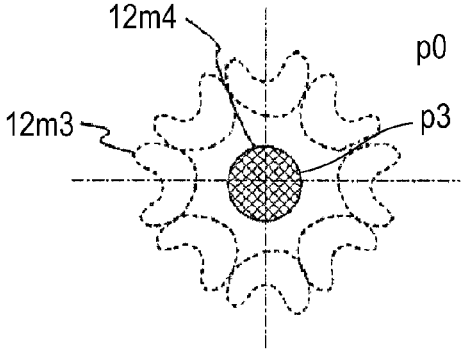

FIG. 10A is a plan view showing an example of a location of injection holes 12*m* when viewed from upstream in a direction of the center axis of the fuel injection valve 1 of the one-stream spray method. FIG. 10B shows an example of a jet location and a jet shape immediately below the respective injection holes 12*m* located as in the example of the injection hole location of FIG. 10A, and jets 12*m*1 in every adjacent pair are in close proximity to each other. FIG. 10C shows an example of a mist location and a mist shape at a position downstream of the break length position. It also shows a state in which respective mists 12*m*2 come close to the Z axis at the same time because the respective mists 12*m*2 are connected in the circumferential direction. FIG. 10D shows an example of a mist location and a mist shape when the Coanda effect is exerted and an example of mist location and a mist shape when an injection amount distribution is maintained so as to peak substantially at the center and a mist angle is maintained small until catching of ambient air by the mists and a behavior of a resulting air flow along a downstream flow direction in a predetermined in-mist portion taking place after the mists appear substantially as one solid mist vanish substantially. It shows a state in which a compact solid mist 12*m*4 is formed by mists 12*m*3 on which the the Coanda effect is exerted.

In the fifth embodiment, all the injection holes 12*m* are set in a radial fashion. The jets 12*m*1 immediately below the respective injection holes 12*m* have a cross section of substantially an oval shape or substantially a crescent shape and components in the long axis direction or components in a normal direction to the curved portion are located substantially at equal intervals in substantially the circumference direction. Hence, the Coanda effect is exerted substantially uniformly all along the circumference direction and the sectional shapes of the jets 12*m*1 immediately below the respective injection holes come closer to one another or gather closer in the same manner by way of turning to mists 12*m*2 and 12*m*3 due to a difference between the external pressure p0 and the internal pressures p1, p2, and p3 so that the mists appear substantially as one solid mist. Thereafter, the mists are allowed to catch ambient air chiefly based on the momentum theory and thereby to induce an air flow along a downstream flow direction in a predetermined in-mist portion. Then, an injection amount distribution is maintained so as to peak substantially at the center and a mist angle is maintained small until behaviors as above vanish substantially. Owing to this configuration, it becomes possible to achieve a more compact atomized mist 12*m*4 by one-stream spray. Behaviors of jets from the adjacent injection holes and flows of mists and an ambient air catching level are the same as those in FIG. 6A through FIG. 7B. The jet location is not necessarily symmetric with respect to the X axis or the Y axis.

Sixth Embodiment

A sixth embodiment of the invention will be described with reference to FIG. 11A through FIG. 11D.

Figure 11A:
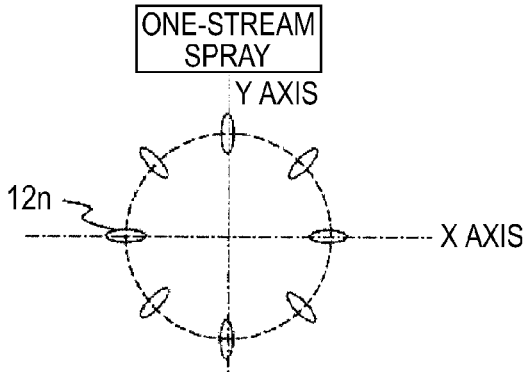
FIG. 11A through 11D are views used to describe a manner in which mists of a sixth embodiment gather.
Figure 11B:
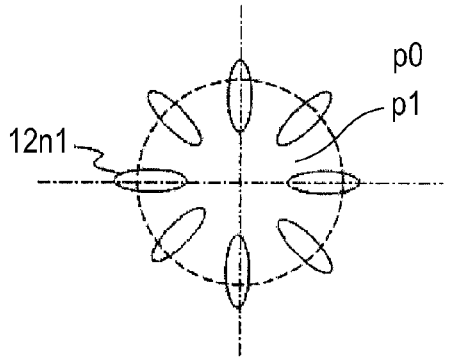
Figure 11C:
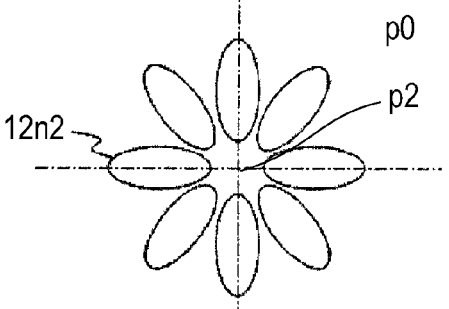
Figure 11D:
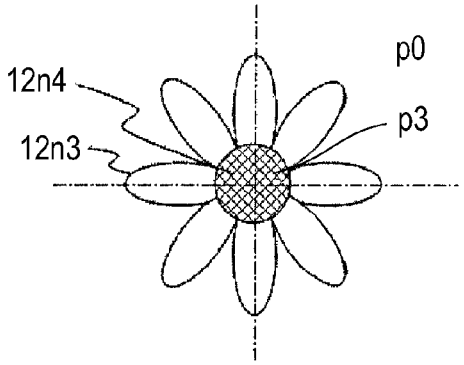

FIG. 11A is a plan view showing an example of a location of injection holes 12*n* when viewed from upstream in a direction of the center axis of the fuel injection valve 1 of the one-stream spray method. FIG. 11B shows an example of a jet location and a jet shape immediately below the injection holes 12*n* located as in the example of the injection hole location of FIG. 11A. FIG. 11C shows an example of a mist location and a mist shape at a position downstream of the break length point. FIG. 11D shows an example of a mist location and a mist shape when the Coanda effect is exerted and an example of a mist location and a mist shape when an injection amount distribution is maintained so as to peak substantially at the center and a mist angle is maintained small until catching of ambient air by the mists and a behavior of a resulting air flow along a downstream flow direction in a predetermined in-mist portion taking place after the mists appear substantially as one solid mist vanish substantially.

In the sixth embodiment, all the injection holes 12*n* are set in a radial fashion and jets 12*n*1 immediately below the respective injection holes 12*n* have a cross section of substantially an oval shape or substantially a crescent shape. Components in the long axis direction or components in a normal direction are arranged in substantially a radial fashion or substantially a windmill fashion.

Owing to this configuration, opposing surfaces of adjacent mists 12*n*2 come closer to each other at the center of a whole mist and the Coanda effect is exerted strongly due to a difference between the external pressure p0 and the internal pressures p1, p2, and p3. Because of influences of this, the mists as a whole are attracted toward the center and the mists come closer to one another or gather closer by way of shaping sectional shapes of mists 12*n*2 and 12*n*3 and the mists appear substantially as one solid mist. Thereafter, the mists are allowed to catch ambient air chiefly based on the momentum theory and thereby to induce an air flow along a downstream flow direction in a predetermined in-mist portion. Then, an injection amount distribution is maintained so as to peak substantially at the center and a mist angle is maintained small until behaviors as above vanish substantially. Owing to this configuration, it becomes possible to achieve a more compact atomized mist 12*n*4 by one-stream spray. Behaviors of jets from the adjacent injection holes and flows of mists and an ambient air catching level are the same as those in FIG. 6A through FIG. 7B. The jet location is not necessarily symmetric with respect to the X axis or the Y axis.

When the injection hole plate 11 and portions upstream thereof are arranged in such a manner that an in-hole liquid film is formed by providing rotating movement to a fuel flow flowing therein, components in the long axis direction of the jets having a cross section of substantially a crescent shape immediately below the respective injection holes 12*n* can be arranged in a windmill fashion.

Seventh Embodiment

A seventh embodiment of the invention will be described with reference to FIG. 12.

FIG. 12 is a view used to describe a manner in which mists of the seventh embodiment above gather. Cross sections of mists 33, 34, and 35 that come close to one another are of substantially a circular shape or an elliptical shape. FIG. 12 shows an example of a mist location and a mist shape when an injection amount distribution is maintained so as to peak substantially at the center and a mist angle is maintained small until catching of ambient air by the mists (indicated by spiral arrows 50) and a behavior of a resulting air flow along a downstream flow direction in a predetermined in-mist portion taking place after a difference between an external pressure p0 and an internal pressure p4 of the mists becomes small and the mists appear substantially as one solid mist vanish substantially. A spread of a collective mist is on the inner side of an outer envelope of a virtual whole mist formed by connecting virtual single mist outlines estimated from a direction of substantially an oval shape or substantially a crescent shape, which are a sectional shape of the respective jets, or an outermost peripheral portion thereof. Owing to this configuration, the collective mist is in an extremely stable state and it becomes possible to achieve a compact atomized mist that behaves in a stable manner in response to a disturbance factor, such as a change in atmospheric conditions. Behaviors of jets from the adjacent injection holes and flows of mists and an ambient air catching level are the same as those in FIG. 6A through FIG. 7B.

The inventors repetitively conducted a study and found that let d1 and d2 be respectively diameters of circles when an outer envelope and an inner envelope of the respective mist outlines are assumed to be substantially circles at a position at which the respective mists start to interfere with one another when viewed on a cross section perpendicular to a mist direction, then it is suitable for the mists to gather when $d2 \leq 1/2d1$ is established.

Eighth Embodiment

Figure 13A:
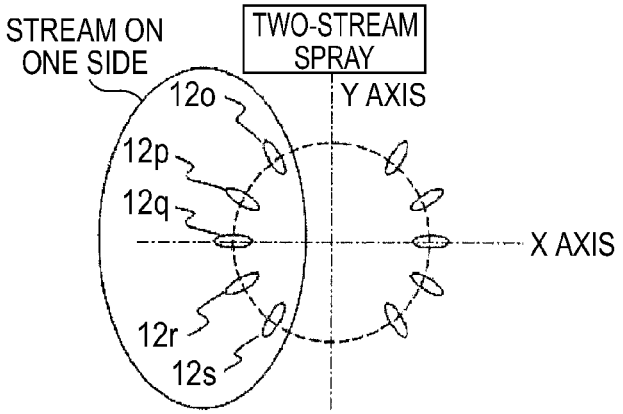
FIG. 13A through FIG. 13D are views used to describe a manner in which mists of an eighth embodiment gather.
Figure 13B:
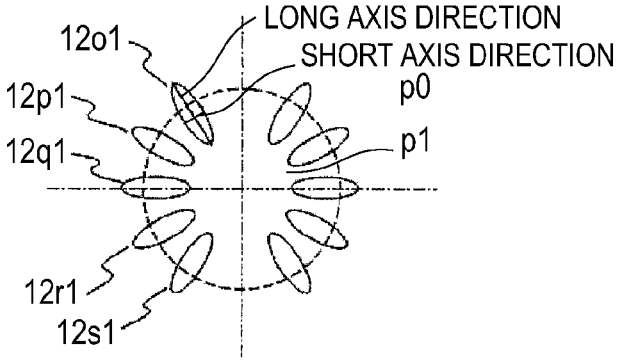
Figure 13C:
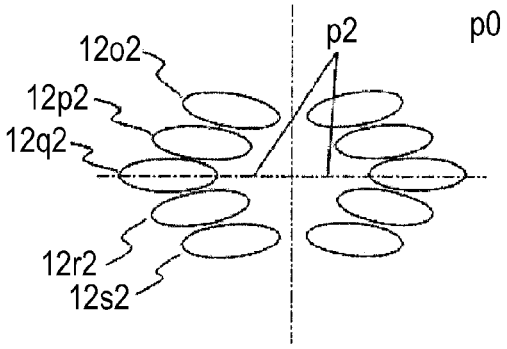
Figure 13D:
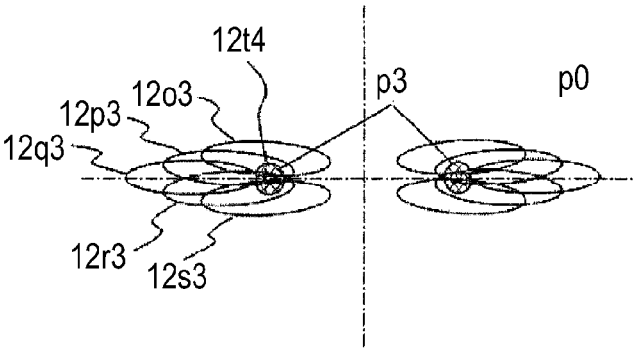

An eighth embodiment of the invention will be described with reference to FIG. 13A through FIG. 13D. FIG. 13A is a plan view showing an example of an injection hole location when viewed from upstream in a direction of the center axis of the fuel injection valve 1 of the two-stream spray method. The respective injection holes 12*o* through 12*s* correspond to a stream of spray on one side of the two-stream spray and data maybe different from one injection hole to another. FIG. 13B shows an example of a jet location and a jet shape immediately below the respective injection holes located as in the example of the injection hole location of FIG. 13A. FIG. 13C shows an example of a mist location and a mist shape at a position downstream of the break length position. FIG. 13D shows of a mist location and a mist shape when the Coanda effect is exerted and an example of mist location and a mist shape when an injection amount distribution is maintained so as to peak substantially at a predetermined portion and mists are maintained compact until catching of ambient air by the mists and a behavior of a resulting air flow along a downstream flow direction in a predetermined in-mist portion taking place after the mists appear substantially as one solid mist vanish substantially.

In the eighth embodiment, jets 12*o*1 through 12*s*1 immediately below the respective injection holes have a cross section of substantially an oval shape or substantially a crescent shape. A difference between an external pressure and an internal pressure is set so that components in a long axis direction or components in a normal direction to a curved portion come close and gather substantially in a straight line or substantially in a curved line. Owing to this configuration, it becomes possible to collect components of mists 12*o*2 through 12*s*2 in a short axis direction in a direction of the Y axis in the vicinity of the X axis by the Coanda effect. The mists therefore come closer or gather closer by way of turning from the mists 12*o*2 through 12*s*2 to mists 12*o*3 through 12*s*3. It thus becomes possible to achieve a more compact atomized mist 12*t*4. Behaviors of jets from the adjacent injection holes and flows of mists and an ambient air catching level are the same as those in FIG. 6A through FIG. 7B. The main purpose of this embodiment is to let the mists gather in substantially an oval shape or substantially a crescent shape and the mists are not necessarily along the direction of the X axis. Also, in the case of two-stream spray, the both streams of spray are not necessarily symmetric with respect to the Y axis.

Ninth Embodiment

A ninth embodiment of the invention will be described with reference to FIG. 14.

Figure 14:
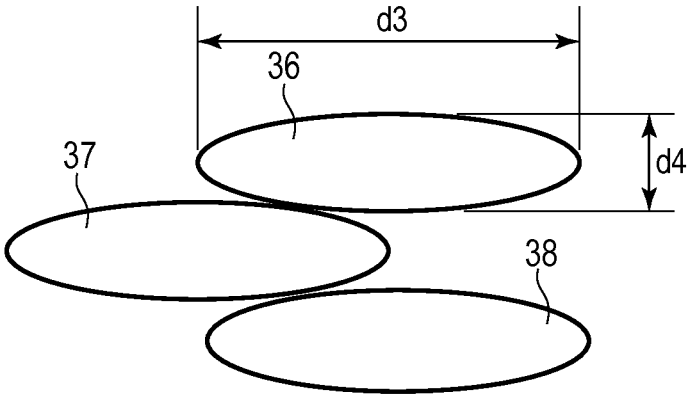
FIG. 14 is a view used to describe a manner in which mists of a ninth embodiment gather.

FIG. 14 is a view used to describe a manner in which mists of the seventh embodiment above gather. Cross sections of mists 36, 37, and 38 that come close to one another are of substantially an oval shape. When an injection amount distribution is maintained so as to peak substantially at a predetermined portion and mists are maintained compact until catching of ambient air by the mists chiefly based on the momentum theory and an induction of a resulting air flow along a downstream flow direction in a predetermined in-mist portion taking place after a difference between an external pressure and a pressure in close-proximity portions of the mists becomes small and the mists appear substantially as one solid mist vanish substantially, an injection amount distribution on the cross section of the collective mist is substantially an oval distribution. A spread of the collective mist in the short axis direction is shorter than a length in the short axis direction of a virtual whole mist formed by connecting virtual single mist outlines estimated from a direction of the jets of substantially an oval shape or substantially a crescent shape.

Owing to this configuration, the collective mist is in an extremely stable state and it becomes possible to achieve a compact atomized mist that behaves in a stable manner in response to a disturbance factor, such as a change in atmospheric conditions. Behaviors of jets from the adjacent injection holes and flows of mists and an ambient air catching level are the same as those in FIG. 6A through FIG. 7B. The main purpose of this embodiment is to let the mists gather substantially in an oval shape or substantially a crescent shape and the mists are not necessarily along the direction of the X axis. Also, in the case of two-stream spray, the both streams of spray are not necessarily symmetric with respect to the Y axis.

The inventors repetitive conducted a study and found that let d3 and d4 be a length in the direction of the long axis and a length in the direction of the short axis, respectively, when envelopes of the respective mist outlines are assumed to be substantially an oval shape or substantially a crescent shape at a position at which the respective mist outlines start to interfere with one another when viewed on a cross section perpendicular to a mist direction, then it is suitable for the mists to gather when $d4 \leq 1/2d3$ is established.

Tenth Embodiment

Figure 15:
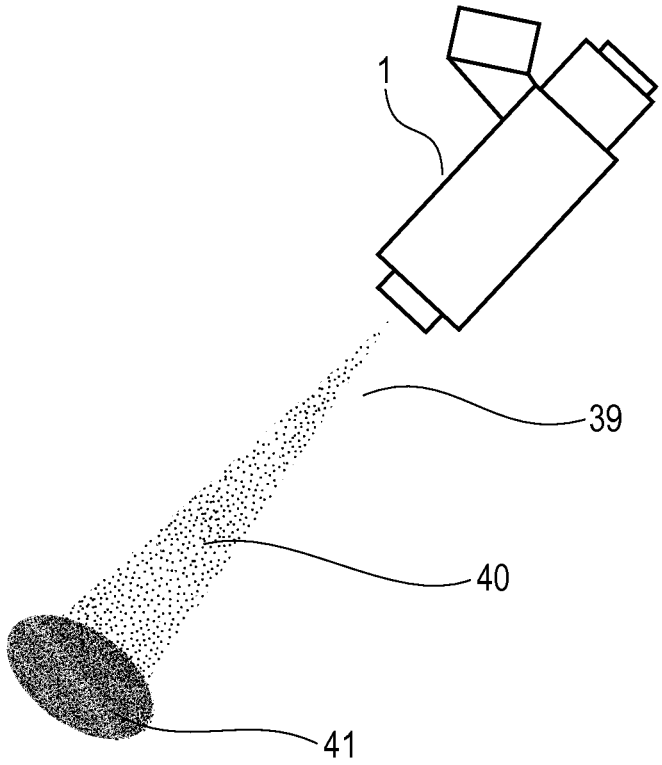
FIG. 15 is a view used to describe a mist of a tenth embodiment.

A tenth embodiment will be described with reference to FIG. 15.

Regarding an collective mist 39 formed by the fuel injection valve 1, after the collective mist appears substantially one solid mist, a carrying force of the mists is lost almost completely when catching of ambient air by the mists chiefly based on the momentum theory and a resulting air flow along a downstream flow direction in a predetermined in-mist portion are attenuated. Hence, a mist 40 accompanied with catching of ambient air and a resulting air flow along a downstream flow direction in a predetermined in-mist portion is formed as a mist 41 having an abruptly suppressed carrying force. It thus becomes possible to achieve a compact atomized mist of a specification with a mist carrying force adjusted to a predetermined length.

As has been described above, a plurality of mists can gather more readily as smaller particles are atomized. However, once catching of ambient air and a resulting air current along a downstream flow direction in a predetermined in-mist portion attenuate, mist particles of a small particle size having small momentum and an air flow are turned to swirls rolling up outward (a ring swirl or a plurality of large swirls) because they give in to a resistance of air standing still in front of them. It thus becomes possible to form a mist with an abruptly suppressed carrying force. To achieve such a mist, it is only necessary to change features of the respective single mists so that a level of swirl development on the outer periphery of a whole mist becomes high as those in FIG. 12C or FIG. 12D of Non-Patent Document 2. More specifically, a degree of in-hole contracted flow is increased by changing injection hole data, a degree of in-hole contracted flow is increased by rising an injection fuel pressure, or a shear condition with post-ejection air is heightened by raising an injection fuel pressure, so that air is caught readily. In a case where an injection fuel pressure is raised, an existing fuel injection valve for port injection system is operable up to a system fuel pressure as high as about 1 MPa at a level of modification, and is therefore available to change a mist behavior.

The mist 41 loses energy to behave against an intake air flow. It thus becomes possible to achieve a compact atomized mist capable following the intake air flow. In other words, it becomes possible to achieve an atomized mist following an intake air flow in the intake port by minimizing adhesion of mist onto the wall surface of the intake port and the intake valve according to a shape of the intake port immediately before the intake valve regardless of the injection timing.

Eleventh Embodiment

An eleventh embodiment of the invention will be described with reference to FIG. 8A through FIG. 8D, FIG. 10A through FIG. 10D, and FIG. 16A through FIG. 16C.

Figure 16A:
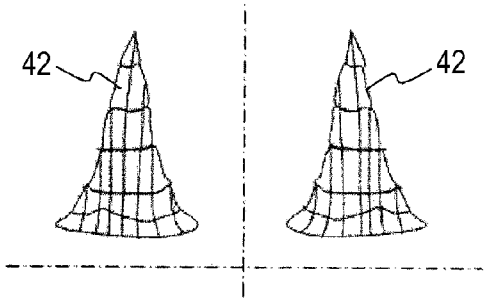
FIG. 16A through FIG. 16C are views used to describe an injection amount distribution of an eleventh embodiment.
Figure 16B:
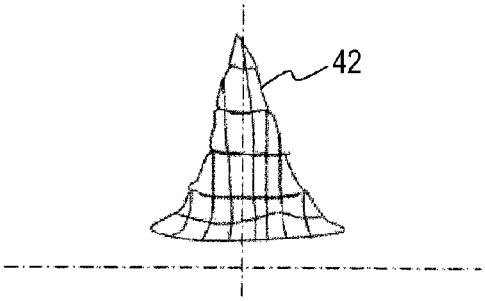
Figure 16C:
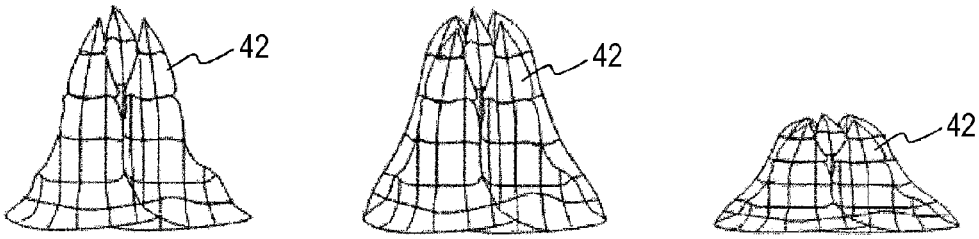

FIG. 16A shows an example of an injection amount distribution by the two-stream spray shown in FIG. 8A through FIG. 8D. FIG. 16B is an example of an injection amount distribution by the one-stream spray shown in FIG. 10A through FIG. 10D. FIG. 16C is an example of an injection amount distribution of the eleventh embodiment. In the eleventh embodiment, an air flow along a downstream flow direction in a predetermined in-mist portion in an entire collective mist is formed at a plurality of points as is shown in FIG. 16C in a gathering phenomenon of a plurality of mists 42. Owing to this configuration, a force attracting mist particles is exerted in a portion of the respective air flows and gathering of mists converges in the portion of the respective air flows so that the collective mist shows a stabilized behavior. Hence, without having to let an injection amount distribution of the collective mist peak substantially at the center in the mist shape, it becomes possible to achieve a compact atomized mist with which it becomes possible to set an injection amount distribution of the collective mist as desired. This configuration is also applicable to the other embodiments above and below.

Twelfth Embodiment

A twelfth embodiment of the invention will be described with reference to FIG. 17.

Figure 17:
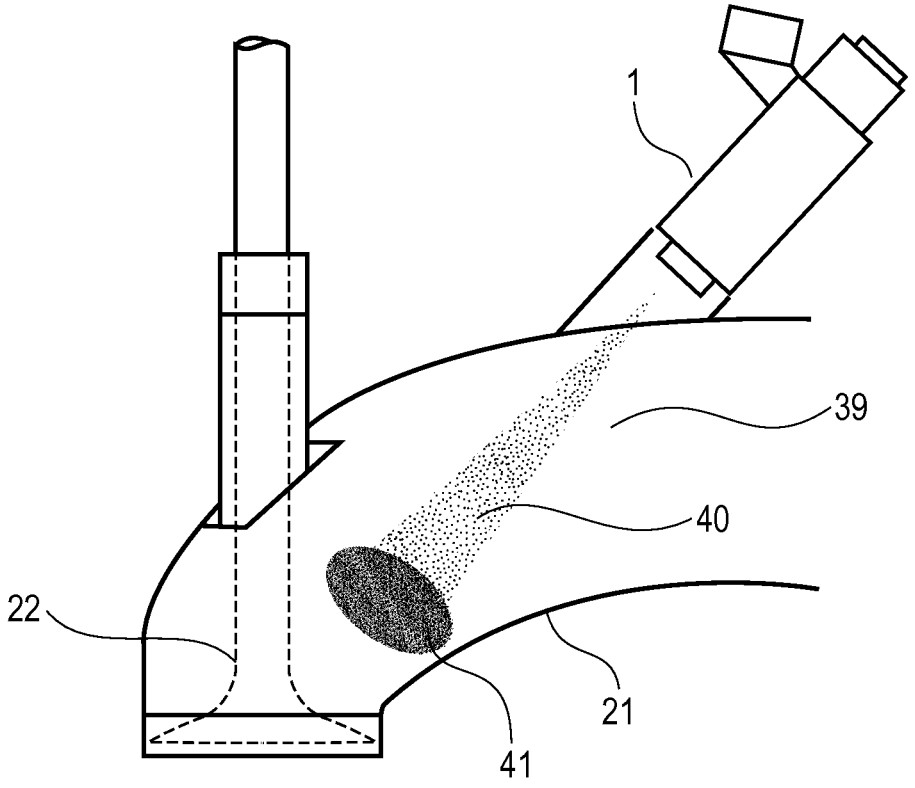
FIG. 17 is a view used to describe an injection system of a twelfth embodiment.

FIG. 17 shows only one cylinder in a multi-cylinder engine. In the twelfth embodiment, in the case of the port injection system, a length in a mist direction with which suppression of a carrying force is started abruptly due to attenuation of catching of ambient air by the mists chiefly based on the momentum theory and a resulting air flow along a downstream flow direction in a predetermined in-mist portion taking place after the mists appear substantially as one solid mist is made adjustable in response to a length from an injection point to an intake valve 22 in an intake manifold 21 or a length from the injection point to the wall surface of the intake port to which a mist tip end 41 opposes. Owing to this configuration, in an intake port injection system in an actual engine, it becomes possible to achieve a compact atomized collective mist 39 of a mist specification with which mist adhesion onto the wall surface of the intake port and the intake valve can be suppressed according to a shape and a size of the respective intake ports and the mists readily follow an intake air flow.

Thirteenth Embodiment

A thirteenth embodiment of the invention will be described with reference to FIG. 18.

Figure 18:
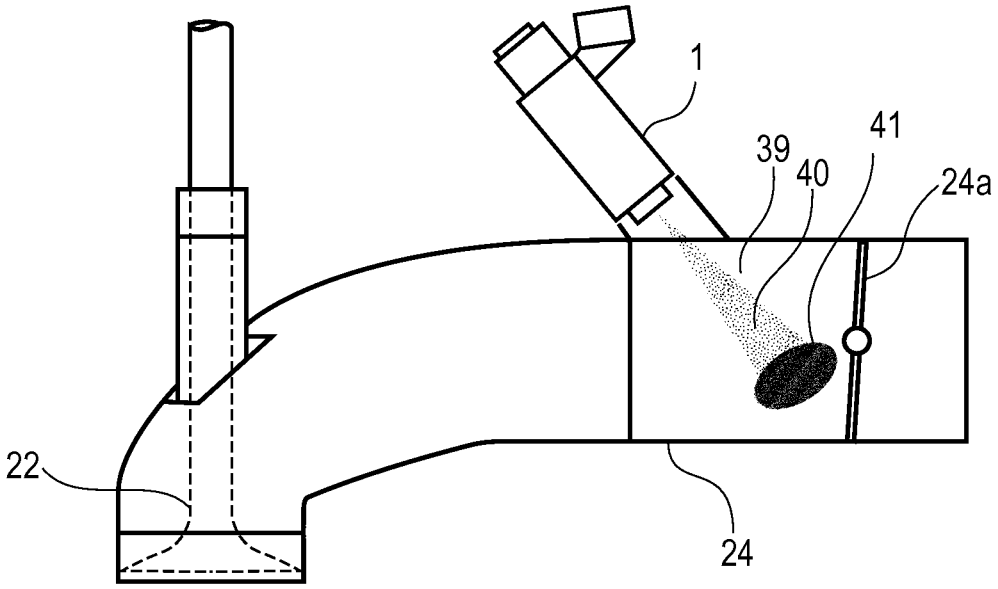
FIG. 18 is a view used to describe an injection system of a thirteenth embodiment.

FIG. 18 shows only one cylinder in a multi-cylinder engine. The fuel injection valve 1 is mounted on a throttle body 24. A tip end is attached with an inclination toward an upstream part at a position downstream of a throttle valve 24*a* of the throttle body 24, so that fuel is injected upstream of an intake air flow. In the thirteenth embodiment, because a carrying force of the atomized mist can be suppressed abruptly immediately before the wall surface of the throttle body 24 and the throttle vale 24*a*, by injecting fuel upstream first, margins in terms of time and space are allowed to form an air-fuel mixture. In a case where the intake port is extremely short, an injection amount distribution among the cylinders becomes imbalanced or a ratio of mist adhesion to the intake port is increased when fuel is injected downstream. Hence, an air-fuel mixture forming state is deteriorated as a result and the engine performance cannot be enhanced. However, the thirteenth embodiment can overcome this inconvenience.

Further, by exploiting the characteristics of the mists of the invention, it becomes possible to form a mist at a wide angle by suppressing a carrying force in the vicinity of the intake valve while suppressing mist adhesion to the intake port up to the vicinity of the intake vale of each cylinder by providing only one fuel injection valve in an intake pipe collecting portion. In so-called utility engine and small-size engine, carburetors are being replaced by the fuel injection system. However, because a noticeable cost increase is undesirable, it is quite effective to enhance a cost performance of the engine by using only one fuel injection valve in the multi-cylinder engine (so-called single point injection). The advantages described above can be achieved even when the fuel injection valve 1 is attached separately from the throttle body 24.

It should be appreciated that the respective embodiment above can be combined and modifications and omissions can be made as needed in the respective embodiments above within the scope of the invention. For example, the embodiments above have described cases of two-stream spray or one-stream spray as a mist pattern. However, as long as being a compact atomized mist, the mist pattern can be a multi-stream spray such as three-stream spray, a combination of mists having different sectional shapes, a combination of asymmetric mists or mists having different carrying forces, or a combination of different atomized mists.

The embodiments above have described an electromagnetic fuel injection valve. It should be appreciated, however, that a drive source of a different type is also available and it goes without saying that the invention is also applicable not only to mechanical and intermittent injection valves but also to a continuous injection valve.

Besides a fuel injection valve, usages and required functions of spray apparatus vary widely for a general industrial use, an agricultural use, use for equipment, use for home, and use for individuals, such as painting, coating, pesticide spraying, cleaning, humidification, a sprinkler, a sterilization spray, and cooling. Hence, regardless of a drive source, a nozzle type, and a mist fluid, when the invention is applied to an existing spray apparatus, the spray apparatus becomes capable of forming mists that cannot be achieved before.

Various modifications and alterations of this invention will be apparent to those skilled in the art without departing from the scope and spirit of this invention, and it should be understood that this is not limited to the illustrative embodiments set forth herein.

What is claimed is:

1. A mist forming method, comprising:

setting locations of injection holes, a ratio of a length of the injection holes to a diameter of the injection holes, and an angle of the injection holes, in a nozzle portion of an injection hole plate based on a break length position which is a position at which liquid film flowing through the injection holes breaks up and is a break length from the injection holes;

providing a cover plate on the injection hole plate, the cover plate comprising a pedestal portion contacting the injection hole plate and having a first diameter, and a thin portion provided on the pedestal portion in a stacking direction and having a second diameter greater than the first diameter, the thin portion overlapping the injection holes in the stacking direction and forming a radial channel between the thin portion and the injection hole plate;

injecting fuel through the radial channel and out of a fluid injection valve formed on a valve seat having a valve seat surface at a midpoint in a fluid channel, an opening and a closing of the fluid channel being controlled by a valve body which contacts and moves apart from the valve seat surface, and one of the nozzle portion or the injection hole plate being located downstream of the valve seat and having the injection holes, wherein the setting of the locations of the injection holes is performed such that, when the injecting of the fuel is performed, directions of jets of the fuel output from respective injection holes are not brought into coincidence with a direction of a center axis of the injection holes and the jets remain separated from one another in a downstream part past the break length position, and after the jets from the respective injection holes turn into mists at a position downstream of the break length position, the mists gather by a Coanda effect exerted among the mists so that the mists become one solid mist, after which the one solid mist continues to gather as the one solid mist catches ambient air and thereby induces an air flow along a downstream flow direction in a predetermined in-mist portion, and wherein a sectional shape of the jets output from the respective injection holes of the fluid injection valve is a crescent shape and an aspect ratio of the jets is set to 1.5 or greater.

2. The mist forming method using a fluid injection valve according to claim 1, wherein:

outlines of respective mists start to interfere with one another in a range from the break length position to a position twice the break length.

3. The mist forming method using a fluid injection valve according to claim 1, wherein:

mists having a cross section of a polygonal shape are formed at a position downstream of the break length position.

4. The mist forming method using a fluid injection valve according to claim 3, wherein:

the mists having a cross section of the polygonal shape is formed one of the following manners: by creating sides of substantially the polygonal shape by linking extended lines in a normal direction to a curved portion of the crescent shape, which is a sectional shape of the mists, and by allowing tip ends of the crescent shape to form vortexes of substantially the polygonal shape.

5. The mist forming method using a fluid injection valve according to claim 1, wherein:

in a port injection system of a two-stream spray method, an aspect ratio of a sectional shape of the jets immediately below the respective injection holes in the fluid injection valve is greater than 1.5.

6. The mist forming method using a fluid injection valve according to claim 1, wherein:

in a port injection system of a one-stream spray method, a sectional shape of the jets immediately below the respective injection holes in the fluid injection valve is the crescent shape and one of components in a long axis direction and components in a normal direction to a curved portion are located in substantially a circumferential direction at substantially equal intervals.

7. The mist forming method using a fluid injection valve according to claim 1, wherein:

a sectional shape of the jets immediately below the respective injection holes in the fluid injection valve is the crescent shape and one of components in a long axis direction and components in a normal direction are arranged in one of substantially a radial fashion and substantially a windmill fashion.

8. The mist forming method using a fluid injection valve according to claim 1, wherein:

a sectional shape of the one solid mist formed by allowing the mists to gather is one of substantially a circular shape and substantially an elliptical shape; and a spread of the one solid mist is on an inner side of an outer envelope of a virtual whole mist obtained by connecting virtual single mist outlines estimated from one of a direction of the respective jets having the crescent shape and an outermost peripheral portion thereof.

9. The mist forming method using a fluid injection valve according to claim 8, wherein:

let d1 and d2 respectively be diameters of circles when an outer envelope and an inner envelope of respective mist outlines are assumed to be substantially circles at a position at which the respective mist outlines start to interfere with one another when viewed on a cross section perpendicular to a mist direction, the one solid mist establishes $d2 \leq 1/2d1$.

10. The mist forming method using a fluid injection valve according to claim 1, wherein:

components in a normal direction to a curved portion of the crescent shape, which is a sectional shape of the jets, are allowed to come close and gather in one of substantially a straight line and substantially a curved line.

11. The mist forming method using a fluid injection valve according to claim 1, wherein:

a spread of the one solid mist is shorter than a length in a short axis direction of a virtual whole mist formed by connecting virtual single mist outlines estimated from a direction of the jets having the crescent shape.

12. The mist forming method using a fluid injection valve according to claim 11, wherein:

let d3 and d4 respectively be a long axis direction length and a short axis direction length when envelopes of the respective mist outlines are assumed to be the crescent shape at a position at which the respective mist outlines start to interfere with one another when viewed on a cross section perpendicular to a mist direction, the one solid mist establishes $d4 \leq 1/2d3$.

* * * * *